US005636756A

United States Patent [19]

Johnson

[11] Patent Number: 5,636,756

[45] Date of Patent: Jun. 10, 1997

[54] CHILDPROOF CLOSURE WITH MEANS FOR FACILITATING AUTHORIZED REMOVAL

[75] Inventor: Gustav E. Johnson, Westfield, N.J.

[73] Assignee: Lermer Packaging Corp., Garwood, N.J.

[21] Appl. No.: 371,796

[22] Filed: Jan. 12, 1995

[51] Int. Cl.[6] ..... B65D 55/02

[52] U.S. Cl. ..... 215/206; 215/223; 215/224; 215/305

[58] Field of Search ..... 215/206, 223, 215/224, 228, 230, 305

[56] References Cited

U.S. PATENT DOCUMENTS

| | | | |
|---|---|---|---|
| 3,669,295 | 6/1972 | Horvath | 215/206 |
| 3,865,267 | 2/1975 | Morris | 215/206 |
| 3,871,662 | 3/1975 | Hepp et al. | 215/223 |
| 3,926,325 | 12/1975 | Benson | 215/206 |
| 3,980,194 | 9/1976 | Costa | 215/223 |
| 4,043,475 | 8/1977 | Wheeler | 215/223 |
| 4,385,707 | 5/1983 | Leiter | 215/253 |
| 4,406,376 | 9/1983 | Berghahn | 215/224 |
| 4,694,968 | 9/1987 | Proctor et al. | 215/224 |
| 5,246,127 | 9/1993 | Purcell | 215/305 |
| 5,358,129 | 10/1994 | Watts | 215/206 |
| 5,385,253 | 1/1995 | Scharf et al. | 215/305 X |

FOREIGN PATENT DOCUMENTS

| | | | |
|---|---|---|---|
| 1378872 | 10/1969 | France | 215/305 |
| 882887 | 11/1961 | United Kingdom | 215/305 |

*Primary Examiner*—Sue A. Weaver
*Attorney, Agent, or Firm*—Charles E. Temko

[57] ABSTRACT

A childproof closure for containers is particularly suited for use by arthritic or manually handicapped adults which retains child resistant qualities. This is accomplished by a thumb-engageable projection extending from the upper surface of the end wall of the closure at that portion of the circumferential periphery adjacent the opening index mark.

2 Claims, 2 Drawing Sheets

CHILDPROOF CLOSURE WITH MEANS FOR FACILITATING AUTHORIZED REMOVAL

BACKGROUND OF THE INVENTION

This invention relates generally to the field of child resistant closures for relatively small containers used to store medicinals and other contents potentially harmful if eaten by children of tender years. Devices of this general type are well known in the art, and the invention in specific constructional details which enable the opening of the closure by arthritic or other physically handicapped persons.

In the typical child proof container construction, it is known to provide a neck on the container wherein a tapered bead surrounds the mouth. The bead is interrupted over a relatively small arc. Disposed beneath the bead in spaced relation is a radially extending flange having an index mark. The closure includes an end wall and a peripheral side wall, the inner surface of which has one or more inwardly directed flanges which cooperate with the bead on the container mouth to maintain the closure in position. An additional small flange is configured to pass through the interrupted part of the bead, and an index mark is positioned on the outer surface of the side wall at that location. The container is opened by first rotating the closure relative to the container to align the index marks, and subsequently pushing upwardly on the closure in the area of the index mark to resiliently distort the closures sufficient to disengage it from the container. This opening procedure will normally be beyond the abilities of small children, and will frustrate their attempts to open the container while normal adults will have little difficulty. Unfortunately, such containers are often used by the elderly, many of whom have substantial physical disabilities by reason of arthritis, reduced muscular ability and the like. Such adults often have difficulty in gripping the closure to rotate it to the opening position, and once that is achieved, they have further difficulty in prying the closure in an upward direction to dislodge it from the mouth of the container.

The problem has been appreciated in the prior art. A typical attempt at resolution is found in the disclosure of U.S. Pat. No. 5,213,225 granted May 25, 1993 to Roger M. King, et al. The disclosed construction features an upwardly extending flange projecting from the upper surface of the end wall of the closure and extending across a diameter. The flange is provided with a transverse opening for the insertion of a tool, typically a pencil, to provide additional leverage. This construction does facilitate rotation of the closure relative to the container, particularly if a tool is used. However, it does not materially assist an arthritic user in the prying step which follows the alignment step. The flange is of planar configuration and relatively thin, so that it bends easily. It is also not positioned to enable the transmission of the necessary prying force. Most importantly, the flange must be manually engaged between the thumb and forefinger, a manipulation requiring a substantial pinching force of a degree unavailable to many persons.

SUMMARY OF THE INVENTION

Briefly stated, the invention contemplates the provision of an improved childproof closure of the class described in which the above-mentioned shortcomings have been eliminated, or at least substantially ameliorated. To this end, the closure is provided with an upstanding projection of arcuate cross section extending from the periphery of the upper surface of the end wall and centered at the index mark on the side wall of the closure whereby the closure may be removed once it is properly aligned with respect to the index mark on the container by gripping the container, usually of tubular configuration, between the palm of the hand and several fingers, which then positions the thumb of the user against the outer surface of the projection so that pressure from the thumb distorts the closure using the substantial leverage offered by the projection, so that the opening of the container is a one-handed operation. If necessary, in the case of a very feeble user, both hands may be employed.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
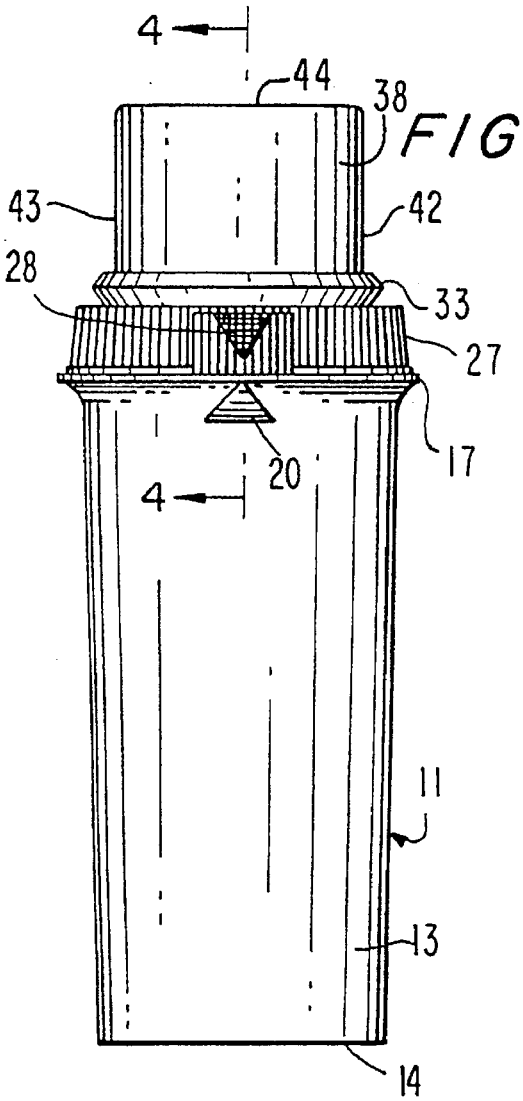
FIG. 1 is a front elevational view of an embodiment of the invention.
Figure 2:
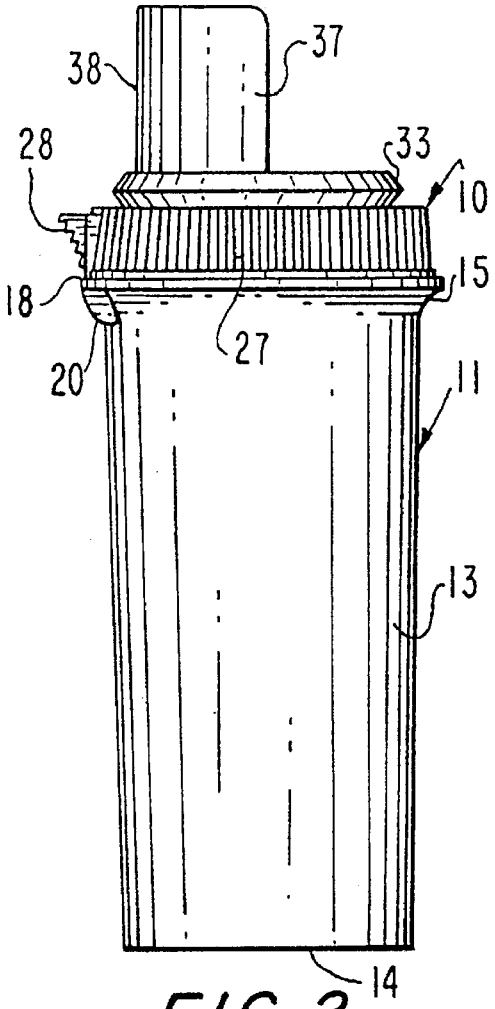
FIG. 2 is a side elevational view thereof.
Figure 3:
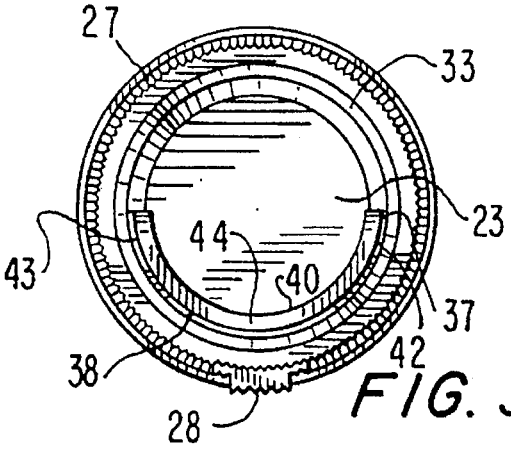
FIG. 3 is a top plan view thereof.
Figure 4:
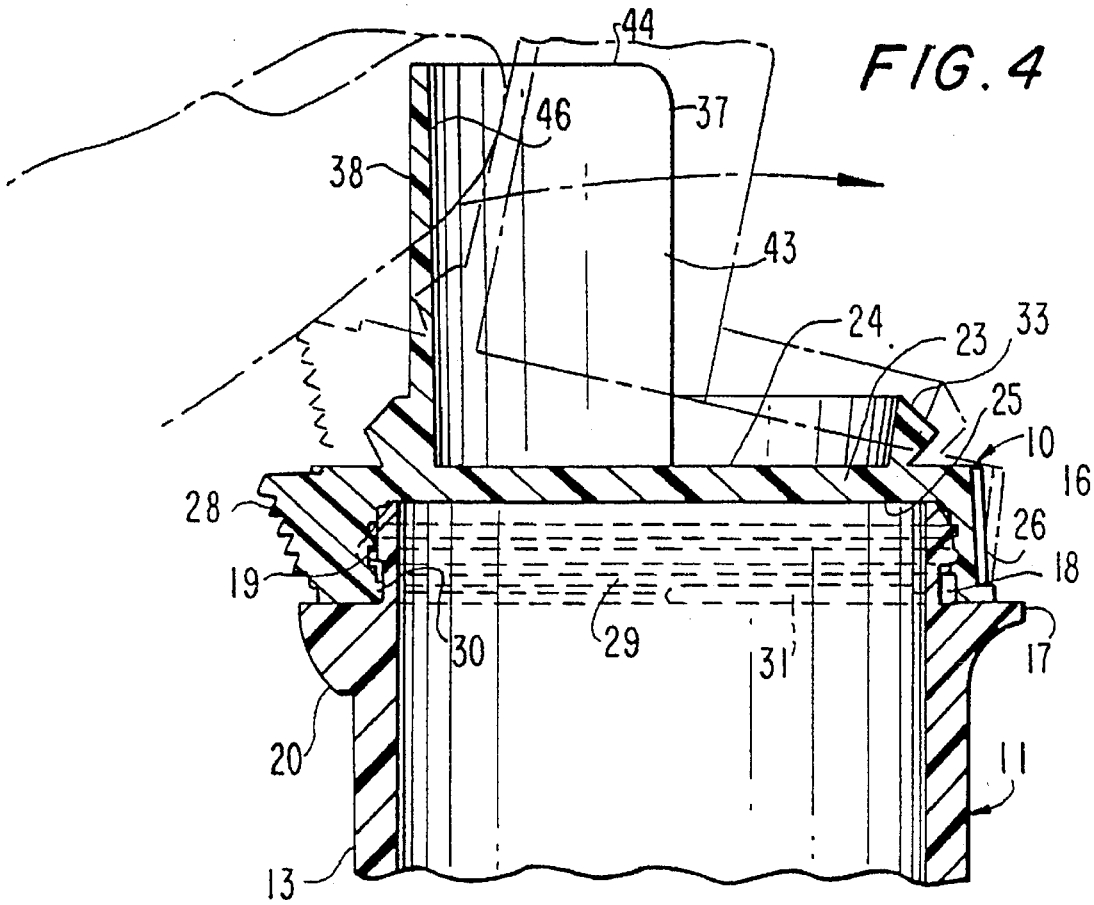
FIG. 4 is a vertical sectional view as seen from the plane 4—4 in FIG. 1.

In accordance with the invention, the device, generally indicated by reference character 10 is formed from a flexible synthetic resinous material known in the art, such as polyethylene, polystyrene, or terepthalate, and is adapted to engage the mouth of a conventional container 11 in known manner.

The container 11 may be of any desired configuration. In the case of a pill container, it normally includes a cylindrical side wall 13 and a planar bottom wall 14. An open upper end 15 is provided with a tapered bead 16 and a radially extending flange 17 separated from the bead 16 by an interstice 18. The bead 16 includes an interrupted segment 19, the location of which is indicated by an index mark 20 depending from the lower surface of the flange 17.

The closure 10 is also generally conventional in configuration, including an end wall 23 having upper and lower surfaces 24–25, a cylindrical side wall 26, an outer surface 27 of which is provided with a marking index 28. An inner surface 29 has a corresponding locking projection 30 and one or more additional locking flanges 31 which engage the bead 16.

Projecting upwardly from the outer surface of the end wall 23 is an annular bead 33 which enables the closure to be engaged with the container in non-childproof relation. Disposed radially inwardly from the bead 33 is a manually engageable tab 37 of arcuate cross section bounded by an outer surface 38, a corresponding inner surface 40, vertical edges 42 and 43, and a horizontal edge 44, the tab extending over an arcuate sector ranging from 90 to 180 degrees, and normally extending upwardly a distance of ½ to 9/16 of an inch in height.

Figure 5:
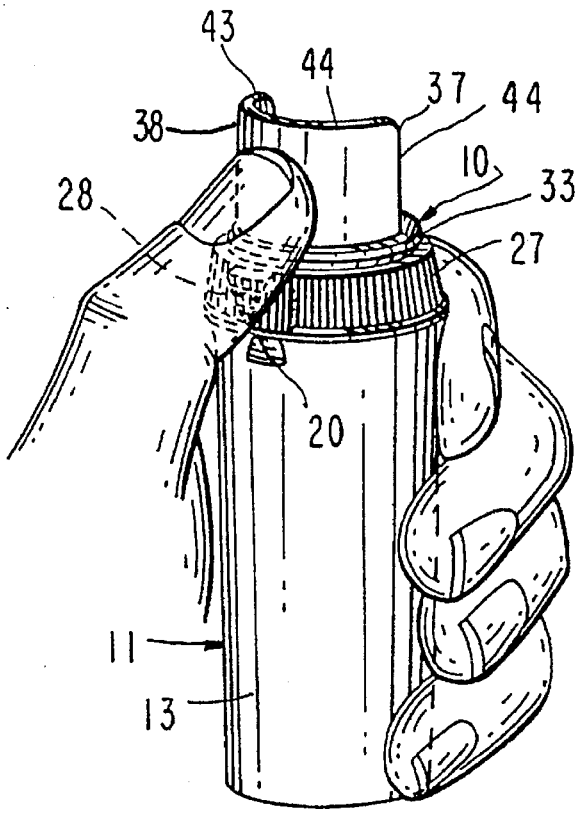
FIG. 5 is a perspective view showing the opening of the closure by a single hand of the user.

Manipulation of the closure to remove it from the container will be apparent from a consideration of FIG. 5 in the drawings. As is conventional, a first step requires the rotation of the closure relative to the container to align the indices so that the projection 30 may be moved through the gap in the bead 16. This may be accomplished either by grasping the outer surface of the side wall 26, or the movement may also be accomplished by grasping the tab 37 if more convenient. Once properly aligned, the container 11 may be grasped by a single hand of the user, the container being encircled by the fingers which then positions the thumb of the user against the outer surface 38 of the tab so that pressure exerted by the thumb will readily distort the closure for removal in normal manner. It will be noted that because of the height of the tab, considerable leverage is afforded, and the container is held in a prehensile grip which is far more convenient than the pinching action between the thumb and forefinger which is used for removal of a conventional closure.

Once engaged, the closure may be inverted, if desired, for non-childproof operation. Since the tab 37 is disposed radially inwardly of the bead 33, it will be disposed within the container when the bead 33 is engaged within the mouth of the same.

I wish it to be understood that I do not consider the invention to be limited to the precise details of structure shown and set forth in the specification, for obvious modifications will occur to those skilled in the art to which the invention pertains.

I claim:

1. A container closure for childproof containers comprising: a planar end wall bounded by inner and outer surfaces and a circular peripheral edge; and a cylindrical side wall extending from said peripheral edge; said side wall having an inner surface and at least one radially inwardly extending projection for engaging a corresponding interrupted bead surrounding the mouth of said container, said side wall having an outer surface and an index mark identifying the position of said at least one projection; and a manually engageable tab extending outwardly perpendicular to said outer surface of said end wall adjacent said peripheral edge in the area of said marking index said tab being of arcuate configuration, and extending over an arc ranging from ninety degrees to one-hundred eighty degrees.

2. A container closure in accordance with claim 1, said outer surface of said end wall having a bead thereon extending outwardly therefrom for engaging the mouth of a container in non-childproof relation, said tab being located radially inward of said bead to permit the same to be positioned within a container upon the engagement of said last mentioned bead.

* * * * *